US005346374A

United States Patent [19]

Güttinger

[11] Patent Number: 5,346,374

[45] Date of Patent: Sep. 13, 1994

[54] ROTATING SPIRAL PUMP WITH COOLING BETWEEN RADIAL STEPS

[75] Inventor: Heinrich Güttinger, Wettingen, Switzerland

[73] Assignee: Aginfor AG fur Industrielle Forschung, Wettingen, Switzerland

[21] Appl. No.: 93,740

[22] Filed: Jul. 20, 1993

[30] Foreign Application Priority Data

Jul. 20, 1992 [EP] European Pat. Off. ..... 92810551.9

[51] Int. Cl.[5] ..... F04C 18/04; F04C 23/00; F04C 29/04

[52] U.S. Cl. ..... 418/6; 418/55.2; 418/59; 418/83; 418/101

[58] Field of Search ..... 418/6, 55.2, 59, 83, 418/101

[56] References Cited

U.S. PATENT DOCUMENTS 3,600,114 8/1971 Dvorak et al. ..... 418/57
3,989,422 11/1976 Guttinger ..... 418/55.2
4,715,797 12/1987 Guttinger ..... 418/59

FOREIGN PATENT DOCUMENTS

3525933A1 1/1987 Fed. Rep. of Germany .
2034409 6/1980 United Kingdom .

*Primary Examiner*—John J. Vrablik
*Attorney, Agent, or Firm*—Burns, Doane, Swecker & Mathis

[57] ABSTRACT

A rotating spiral pump comprises a housing in which two displacement disks are rotatably disposed. The two displacement disks are provided on one side with ribs that extend in spiral fashion and interlock for the purpose of forming pumping chambers, and seal against the opposite displacement disk with their free face ends. The spirally extending ribs are embodied in several steps. The plurality of steps are spatially separated from each other by the formation of an space, and the radially outer step has at least twice as many pumping chambers as the radially inner step. Cooling means in the form of cooling ribs are preferably provided in the space, between the outlet of the radially outer step and the inlet of the radially inner step.

4 Claims, 4 Drawing Sheets

ROTATING SPIRAL PUMP WITH COOLING BETWEEN RADIAL STEPS

FIELD OF THE INVENTION

The invention relates to a rotating spiral pump comprising a housing in which two displacement disks are rotatably disposed, wherein the two displacement disks are provided on a mutually facing side with ribs that extend in spiral fashion. The ribs of each side interlock for the purpose of forming pumping chambers and, with their free face ends, seal against the opposite displacement disk, wherein the spirally extending ribs are embodied in several steps, and the individual steps are separated spatially by the formation of spaces, and wherein the radially outer step has at least one more pumping chamber than the radially inner step.

BACKGROUND AND SUMMARY OF THE INVENTION

A spiral pump with rotating displacement disks is known from German Patent Document DE-C-2603462, FIG. 5. It is distinguished by a nearly pulsation-free conveyance of the gaseous working substance, comprising air or an air-fuel mixture, for instance, and can thus be used advantageously for charging purposes in internal combustion machines. During operation of such a compressor, a plurality of approximately sickle-shaped work chambers are enclosed along the pumping chamber, between the spiral-shaped ribs. They move through an inlet and to an outlet, in the course of which their volume is steadily reduced and the pressure of the working medium is correspondingly increased. With these spiral compressors, the conveyed quantity at a given volumetric efficiency and the maximum boost pressure are defined by the transmission ratio; in particular the inner pressure ratio is fixedly defined because of the spiral geometry selected. In this known machine one displacement disk is seated on an axle journal. The second disk is connected to a drive shaft in a manner fixed against relative rotation. When the first disk rotates, the second disk is carried along in the same direction of rotation and at the same rotation speed. In the process the two disks execute a relative motion in the form of a circular displacement.

Another charger of this type is known from Swiss Patent Document CH-A-501 838. In this case the variant shown in FIGS. 6 and 7 is a multicycle, single-step machine. One of the two rotating disks is connected to a central drive shaft. During rotation of this one disk, the second disk is carried along in the same direction of rotation via the spiral-shaped ribs by means of a transmission of force. The stationary axle on which the second disk is seated is hollow for the purpose of guiding the working medium to be conveyed out of the machine. These multicycle machines have the advantages that each displacement disk is completely counterbalanced individually, and that a more uniform, nearly pulsation-free conveyance is possible. In addition, the radial displacement of the two disks and thus the eccentricity between the two rotating shafts is less than in single-cycle machines, which leads to lower slip speeds between the spiral-shaped ribs. In principle, therefore, this type of compressor can be operated at higher rpm.

Another multi-step spiral pump is known from this same reference. However, it is a single-cycle machine that furthermore does not operate rotatingly, but with orbiting spiral ribs; that is, they are stationary on one side. Because in multicycle machines an interior compression is effected between the work chambers, which are disposed one behind the other, special arrangements must be made for the conveyance of non-compressible media, such as liquids. In conveying compressible media, the rising temperature in the downstream work chambers is problematic.

An object of the invention is to create a spiral pump of the type mentioned at the outset, with which high pressures can be attained and with which the tolerance problems caused by temperature as a consequence of varying thermal expansion can be controlled.

This object is attained in accordance with the invention in that cooling means are provided in the intermediate chamber between the outlet of the radially outer step and the inlet of the radially inner step.

The spatial separation of the steps is a simple means for distributing the pressure reduction over the various steps depending on use; the available spatial conditions on the displacement disks can thus be put to optimum use. Through the cooling means provided in the space between the outlet of the radially outer step and the inlet of the radially inner step, the compression heat that has built up to this point can be dissipated. In a first embodiment of the invention, the cooling means can be ribs over which the flow takes place and which extend spirally on one of the displacement disks in the space. Alternatively, the space between steps can be formed with an outwardly positioned box through which the flow passes, the box being open to facing sides of the displacement disks, and extending outwardly on the sides of the displacement disks facing away from each other, wherein this box is provided on its outer walls with cooling fins.

It is advantageous that the sides of the displacement disks facing away from each other are provided with ventilating blades. This measure permits cooling of the displacement disks and, upstream of them, the bearing sections of the machines.

BRIEF DESCRIPTION OF THE DRAWING FIGURES

Three exemplary embodiments of the invention are represented schematically in the drawing, in which:

FIG. 1: is a longitudinal sectional view through a first spiral pump of the present invention;

FIG. 2: is a side view of a first displacement disk of the pump of FIG. 1;

FIG. 3: is a side view of a second displacement disk of the pump of FIG. 1;

FIG. 4: is a cross-sectional view of the pump along line 4—4 in FIG. 1;

FIG. 5: is a cross-sectional view through a second embodiment of a spiral pump of the present invention;

FIGS. 6 and 7: are reduced-scale side views of the displacement disks of the pump of FIG. 5;

FIG. 8: is a longitudinal sectional view of a third embodiment of a spiral pump of the present invention; and FIG. 9: is a cross-sectional view along line 9—9 in FIG. 8.

The same elements are provided with the same reference numerals in the different figures, but with different indices A, B and C, depending on the exemplary embodiment. The direction of flow of the working medium is indicated by arrows. In all of the examples shown, conveyance of the working medium is effected from radially outward to radially inward; this is not obligatory, however.

DETAILED DESCRIPTION OF THE PREFERRED EMBODIMENTS

For the purpose of explaining the basic mode of operation of the pump, which is not the subject of the invention, the previously mentioned document CH-A-501 838 is referred to. Hereinafter only the machine structure and the progression of the process necessary for understanding the invention will be described briefly.

The machine shown in FIGS. 1 through 4 is a two-step pump in which the step lying radially outside is embodied as two-cycle, and the step lying radially inside as single-cycle.

Figure 1:
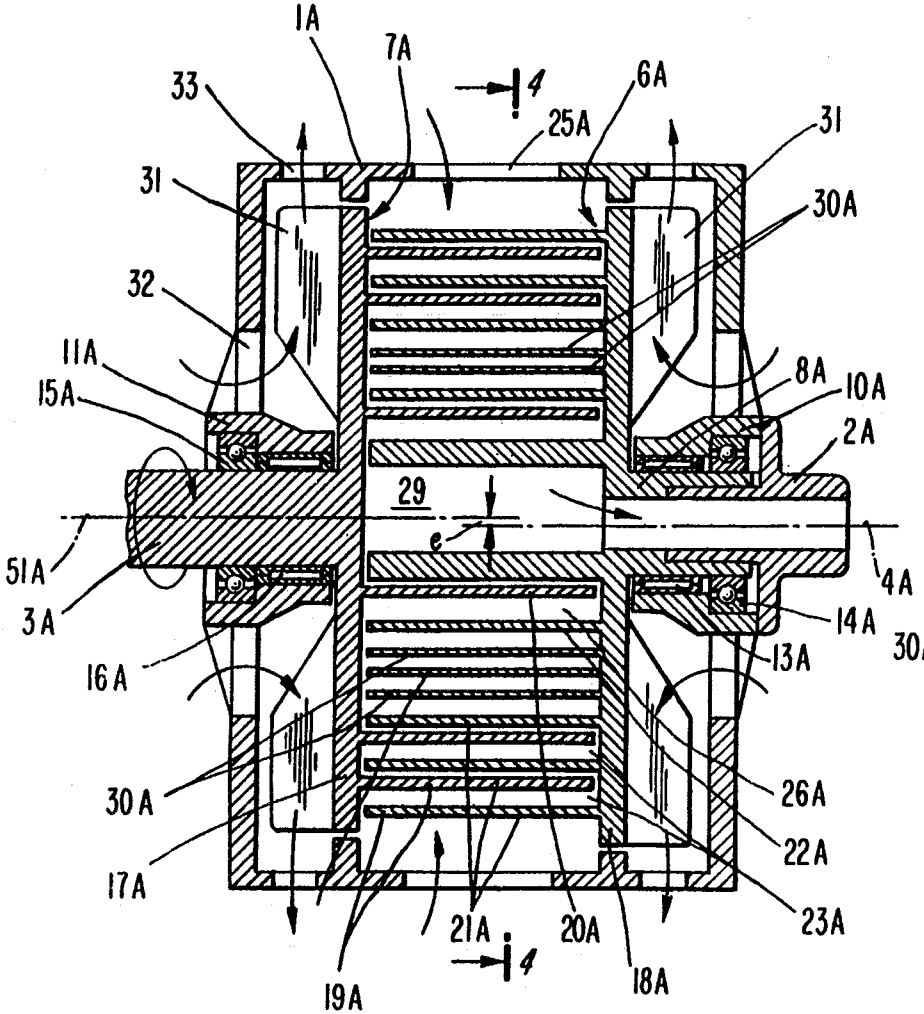

The housing comprising two halves is indicated by 1A in FIG. 1. The two halves are connected to each other via fastening eyes (not shown) for receiving screw connections. An axle journal 2A is disposed in a housing hub 10A in the right half of the housing and protrudes into the interior of the housing. The housing hub 11A of the left half of the housing is penetrated by a drive shaft 3A. Longitudinal axes 4A and 5A of the axle Journal 2A and the drive shaft 3A, respectively, are staggered offset from each other by the eccentricity e. The fact that the value of the eccentricity e in FIG. 1 is small can be attributed to the placement of the ribs on the bias in FIG. 4.

The rotatable displacement disk 6A is loosely placed on the axle journal 2A. Its hub 8A is seated and axially secured on the axle journal by means of two rolling bearings 13A and 14A. The left displacement disk 7A is connected in one piece to the drive shaft 3A. The shaft 3A is seated and axially secured in the housing hub 11A by means of rolling bearings 15A and 16A.

Figure 3:
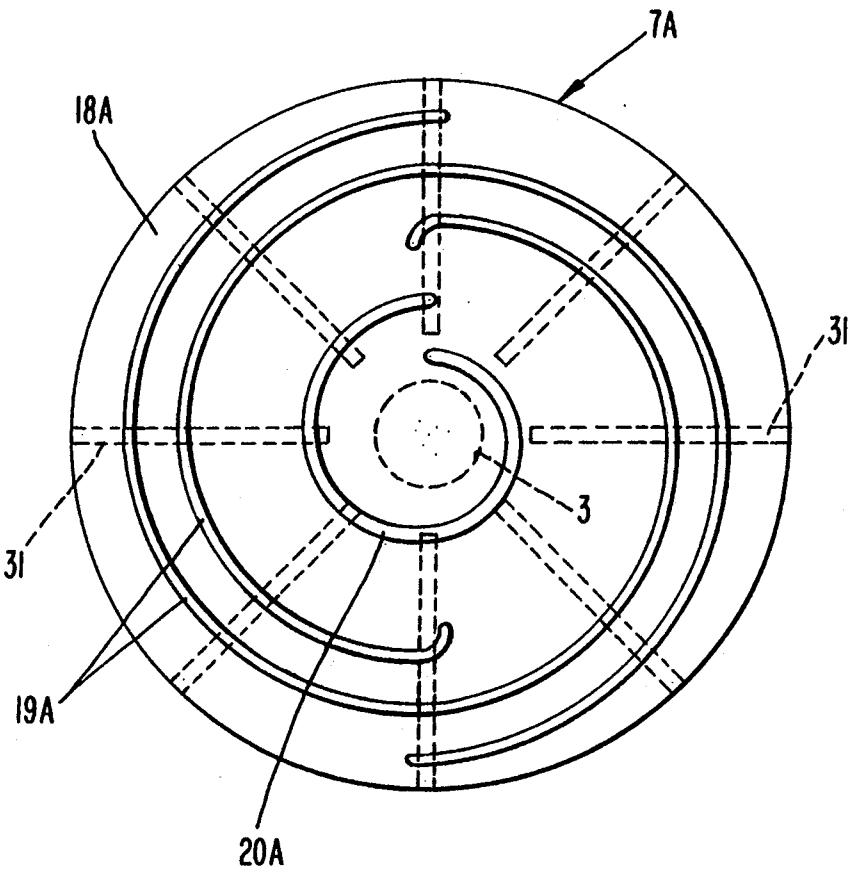
Figure 2:
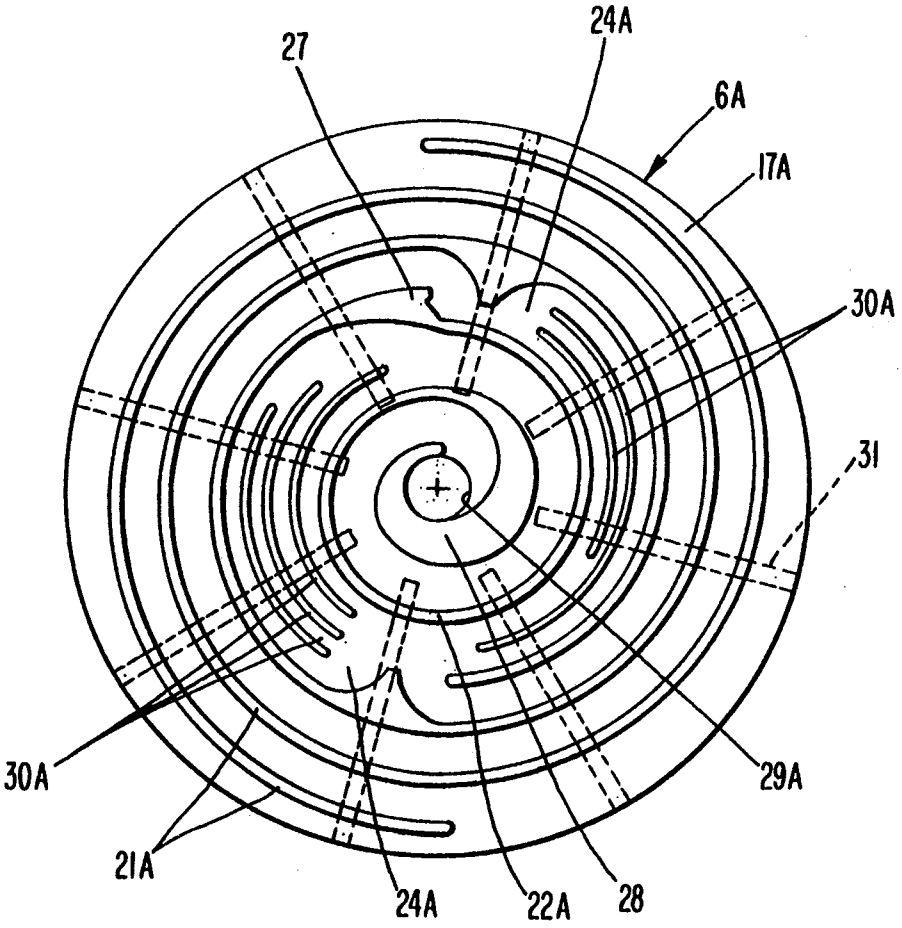

The displacement disks 6A and 7A, front views of which are seen in FIGS. 2 and 3, essentially comprise level plates, 17A and 18A, which extend parallel to each other when assembled (FIG. 1), and ribs that project perpendicularly from the respective plate. These ribs extend in spiral fashion, i.e., they can either be classical spirals or be made up of a plurality of arcs of a circle that are attached to one another.

Ribs 19A and 20A on the driving displacement disk 7A and ribs 21A and 22A on the driven displacement disk 6A are embodied to be two-step.

Ribs 19A of the outer step on the driving displacement disk 7A have an arc length of 450°, and the radially inside ribs have an arc length of 90°, i.e., the last arc section has a significantly smaller bending radius. With this measure an inner compression is already executed in the first step. The plate 18A is equipped with two such ribs 19A, and the ribs are staggered 180° from each other. This leads to the classification of "two-cycle." With such two-cycle machines, two parallel chambers 23A are formed in the arrangement illustrated in FIG. 4, through which the medium is conveyed.

The cooperating ribs 21A of the outer step on the driven displacement disk 6A are configured accordingly, that is, they have a total arc length of 450° and a last arc section that has a significantly smaller bending radius.

Figure 4:
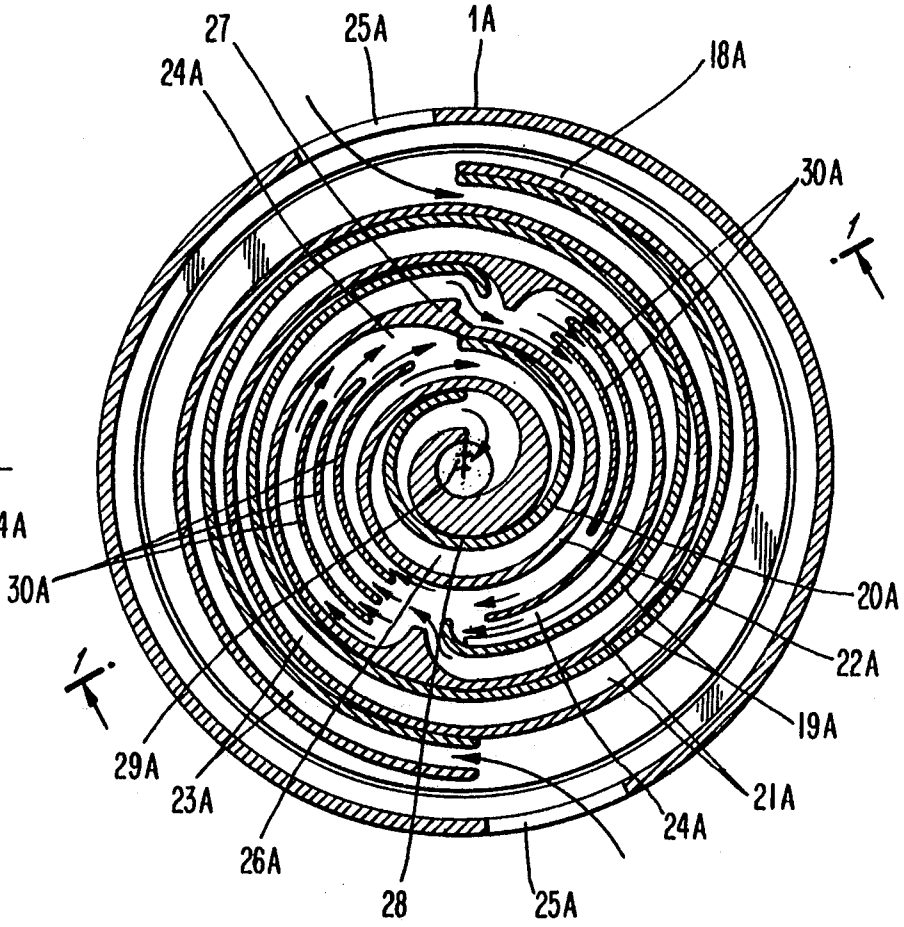

The spiral ribs that are nested when assembled can be seen in FIG. 4. During rotational movement while the machine is in operation, the two pumping chambers 23A opposite one another open toward the spaces 24A at intervals of ½ rotation. At the outer diameter the spirals likewise open at intervals of ½ rotation toward the inlets 25A, from which they aspirate fresh air. The sickle-shaped work chambers that are displaced through the spirals from the inlets 25A in the direction of the spaces 24A are formed in the pumping chambers 23A as a consequence of the repeated, alternating, mutual approach of the ribs.

The working medium flows from these spaces 24A and into the second step, which is single-cycle. On the driving displacement disk 7A, the spiral-shaped rib 20A of this inner step has an arc length of 360°. The rib 22A of the driven displacement disk 6A is correspondingly embodied; the rib 22A also has an actual arc length of only 360°, but has a total arc of wrap of two rotations in accordance with FIG. 2, because it must form the walls that define both sides of the pumping chamber 26A. The transition of rib 21A to rib 22A is not possible without material accumulation 27. For mass balancing, this inevitable asymmetry can be compensated for in that the inner spiral 22A is provided at the end of its arc with an appropriately dimensioned, thickened spiral outlet 28.

The medium conveyed through the single pumping chamber 26A of the second step flows into the outlet 29A and is subsequently conveyed out of the machine through the hollow axle journal 2A.

It goes without saying that not only the radial seal between the ribs—that is, the sealing of the pumping chambers toward the circumference—is important for proper functioning. The axial tightness of the pumping chambers is also significant. For this reason the ribs must rest with their face ends against the plates 17A or 18A of the respective displacement disk facing them. This is generally achieved by means of sealing strips (not shown) that are inserted into corresponding grooves in the free face ends of the ribs.

Cooling means for the working medium that is heated in the first step during compression are located in the spaces 24A, between the outlet of the radially outer ribs 19A, 21A and the inlet of the radially inner ribs 20A, 22A. These are a number of ribs 30A around which the flow passes, and which are disposed only on the driven displacement disk 6A and extend spirally into the two spaces 24A. Their axial length can correspond to the axial length of the spiral ribs. Their wall thickness and the shape of their cross-section, which can of course differ from the rectangular shape, are determined as a function of the heat to be dissipated, as is the selected material, provided that the cooling ribs are not manufactured in one piece with the displacement disk. The spatial conditions in the spaces are taken into consideration in the number and staggering of these cooling ribs, which can be seen particularly in FIG. 2. The flow around the cooling ribs can be seen in FIG. 4. The medium flowing out of the upper step outlet passes through the right space, which is subdivided into three actual cooling conduits by means of two cooling ribs. At the outlet of these cooling conduits, this pre-cooled medium mixes with the partial current flowing out of the lower step outlet. The mixture then flows through the left space, which is subdivided into four cooling conduits by means of three cooling ribs. Their outlets are reversely staggered so that the partial currents can combine while still in the space, and that a homogenous flow is present at the inlet cross-section of the second step.

The cooling ribs 30A carry off the heat to the displacement plate 17A. To cool them, their back side is provided with several radially extending ventilating blades 31. To assure symmetry, the displacement plate 18A also has such ventilating blades. These blades aspirate fresh air via openings 32 disposed directly in the area of the housing hubs 10A, 11A, then guide it past the walls of the displacement disks to be cooled and expel it again via openings 33 at the outer housing diameter. In the process the fresh air conveyed in this way flows around the housing hubs 10A, 11A and, in the course of this, dissipates part of the heat arising in the roller bearings 13A through 16A.

Figure 5:
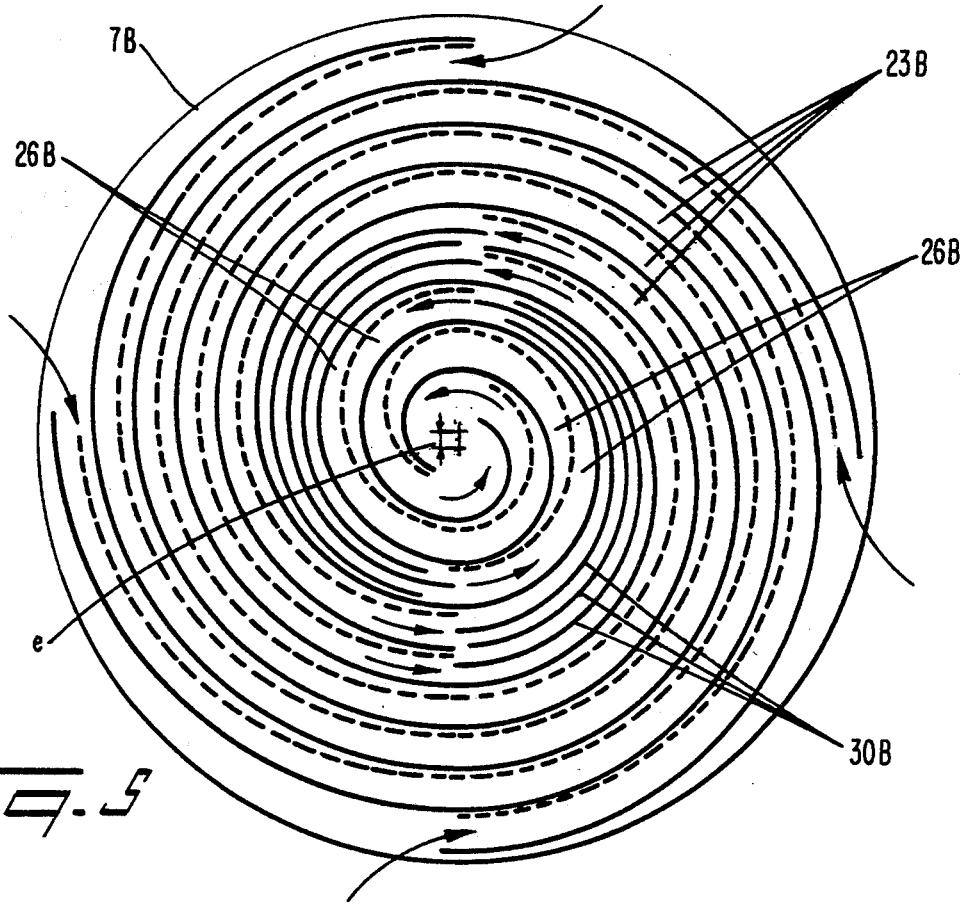
Figure 6:
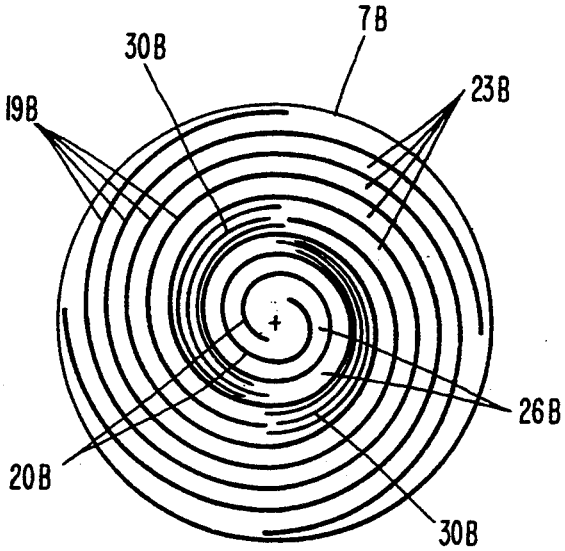
Figure 7:
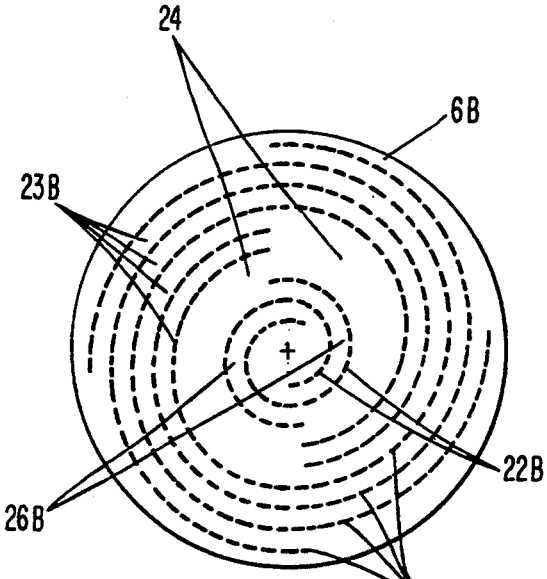

The machine shown in FIGS. 5 through 7 is a two-step pump in which the radially outer step is embodied as four-cycle, and the radially inside step as two-cycle. For the sake of a better overview, the spirals 21B and 22B are shown in FIGS. 5 and 7 in dashed lines. The four outer pumping chambers 23B, which are offset with respect to each other by 90° in the direction of the circumference, discharge into the two spaces 24B, from which the two inner pumping chambers 26B are charged. These two pumping chambers 26B are staggered with respect to each other at 180° toward the circumference. During rotational movement the four successive pumping chambers 23B open toward the spaces at intervals of ¼ rotation. At their outer diameter the spirals likewise open at intervals of ¼ rotation toward the inlets, which are not shown, and from which the spirals aspirate fresh air.

It can be seen from the views in FIGS. 6 and 7 that the two displacement disks 6B and 7B are centrally symmetrical, and thus no particular balancing measures are required.

The canalization and intermediate cooling of the partial streams exiting the first step can be executed without problems in the spaces 24B, which become continually narrower from the outlet of the first step up to the inlet of the second step. For this purpose three equidistant cooling ribs 30B disposed on one of the two displacement disks, such as the driven disk 7B in this case, extend over the entire length of the spaces through which the flow passes and form four cooling conduits of equal width.

In the two examples discussed up to now, the spatially separated steps and the spaces, along with the cooling ribs, are located on the same plate side of the displacement disks.

Figure 9:
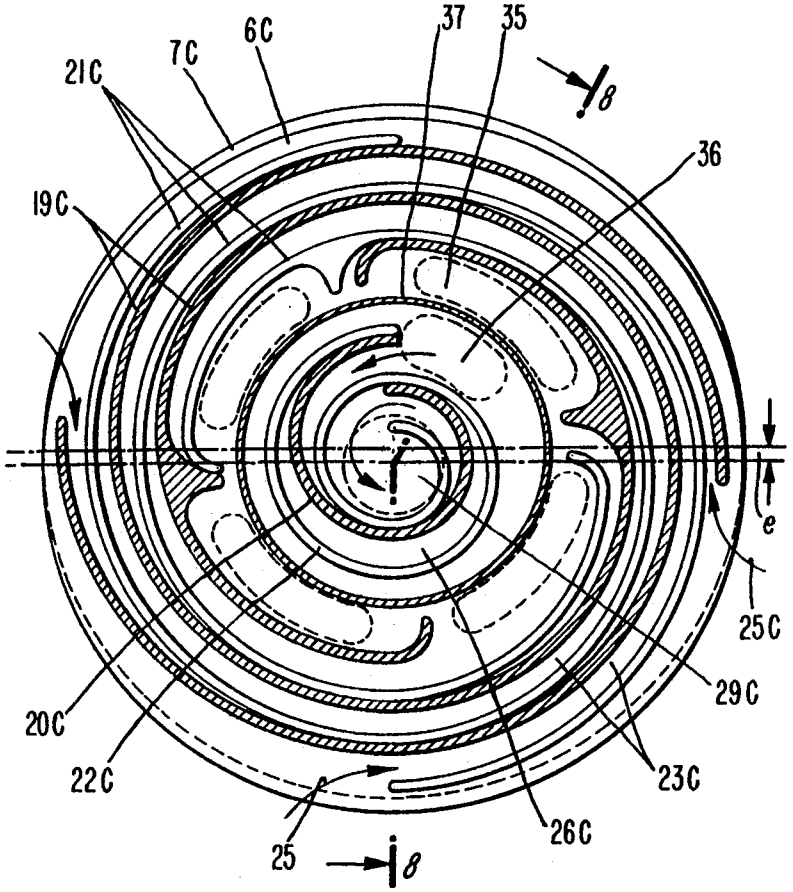
Figure 8:
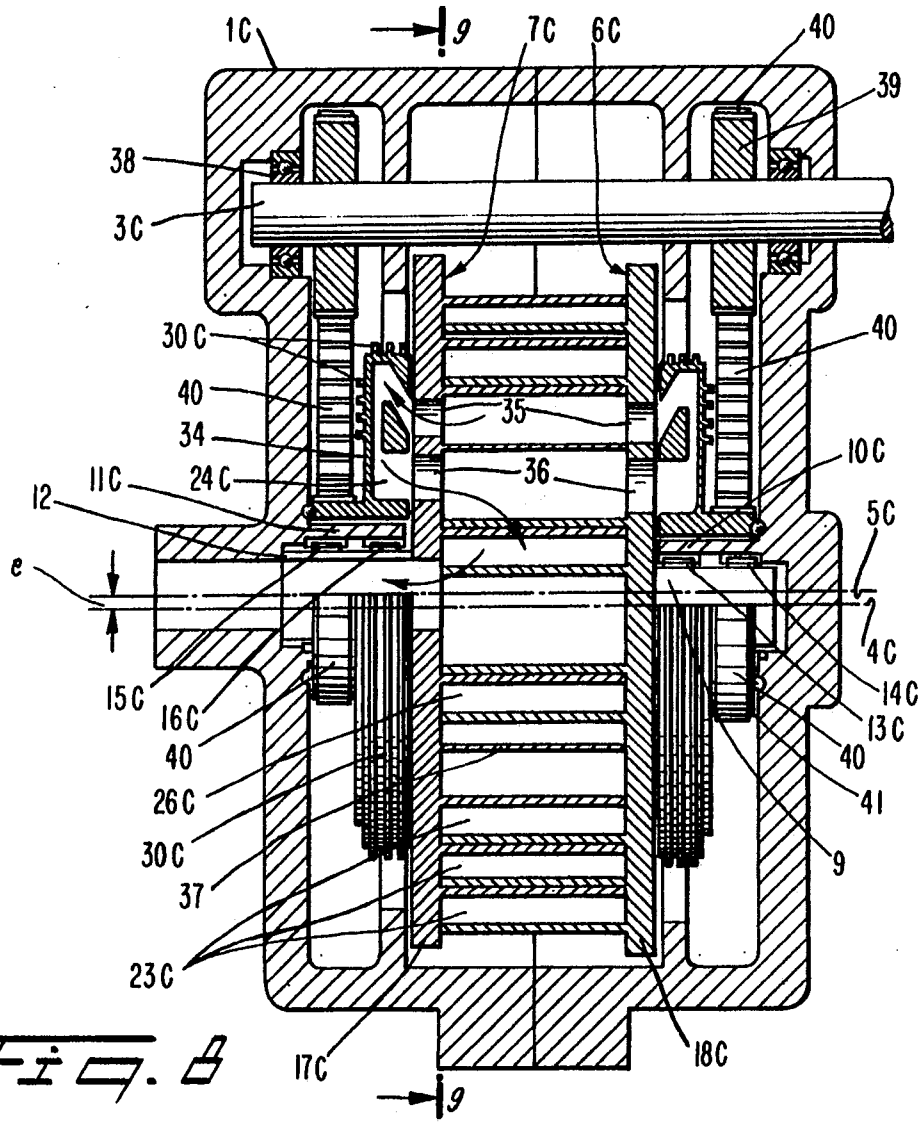

A modified current guidance is shown in FIGS. 8 and 9. This machine has a two-step pump in which the radially outer step is two-cycle, and the radially inner step is single-cycle.

In FIG. 8, the housing comprised of two halves is designated by 1C. Housing hubs 10C, 11C, which protrude into the interior of the housing, are disposed in the two halves. The two displacement plates 17C and 18C of the rotatable displacers 7C or 6C are provided on their back side with shaft journals 12 or 9. These shaft journals are seated on bearings 15C, 16C or 13C, 14C in the housing hubs 11C, 10C. Longitudinal axes 5C or 4C of the two shaft Journals are offset with respect to one another by the eccentricity e. The system is driven by means of a drive shaft 3C, which is seated on ball bearings 38 in the housing 1C, outside the displacement disks. Drive pulleys 39, which drive pulleys 41 via toothed belts 40, are seated on this shaft; for their part, the pulleys 41 are connected to the displacement plates 17C and 18C in a manner that is fixed against relative rotation.

The cross-section in FIG. 9 shows only the nested spirals on their respective displacement disks 7C and 6C. For the sake of a better overview, spirals 19C and 20C of the displacement disk 7C are cross-hatched. In the illustrated case the spiral ribs 19C, 20C of the outer step have an arc length of 1¼ turns, and the last quarter turn is again embodied with an essentially smaller bending radius, as in the machine in accordance with FIG. 4. Each of the displacement plates 17C and 18C is equipped with two such spiral ribs 19C, 20C, and the ribs of a plate are offset by 180° from each other. The spiral arrangement of the outer step, however, is unlike that of the aforementioned machine in accordance with FIG. 4. The displacement plates 17C and 18C are designed such that when spirals are nested, their inlet ends are no longer in the same plane, but are offset by 90° with respect to each other in the direction of the circumference.

Two parallel pumping chambers 23C are formed in such two-cycle machines. During operation these work chambers open at the radially inner end toward the respective step outlet, at intervals of ¼ rotation. At the outer diameter the spirals open in the same cycle toward the inlets 25C, from which they aspirate fresh air. At least with regard to the outer step, such an machine is distinguished in that each displacement disk is completely counterbalanced individually and that a more uniform, nearly pulsation-free conveyance is possible.

The second step is single-cycle. On the one displacement disk 7C the spiral-shaped rib 20C of this inner step has an arc length of one turn, that is, of 360°. The rib 22C of the other displacement disk 6C is embodied correspondingly; the displacement disk also only has an actual arc length of 360°, but has a total angle of wrap of two turns because it must form the walls that define the pumping chamber 26C on both sides.

The medium conveyed through the pumping chamber 26C of the second step flows into the outlet 29C and is subsequently conveyed out of the machine housing through the hollow shaft journal 12.

The intermediate cooling of the medium leaving the first step is effected in annular, co-rotated conduits 34, whose inside chambers form the spaces 24C. One conduit is disposed on each back of the displacement plates 17C and 18C, which are not provided with spiral ribs. To guide the medium to be cooled into the conduit, the plates are provided at the respective spiral ends with holes 35. The medium is diverted into the conduit 34 and flows via a further breach 36 back to the inlet end of the radially inner second step. To dissipate the heat, the conduit are provided on their outer walls with cooling fins 30C. To seal off the two steps from one another, an annular wall 37 that seals tightly against the cooperating displacement plate 18C is disposed on one of the displacement plates 17C. This can be performed in the manner of the spiral ribs with sealing strips inserted into grooves. The annular wall is in a radial plane between the kidney-shaped holes 35 and 36.

What is claimed is:

1. A rotating spiral pump comprising:

a housing;

two opposing displacement disks rotatably disposed in the housing, said displacement disks having inner facing sides and outer sides;

the two displacement disks being provided on the inner facing sides with ribs that extend perpendicularly from the inner faces and are arranged spirally, the ribs from each disk interlocking to form pumping chambers and free face ends of the ribs of each disk sealing against the inner face of the opposing displacement disk;

the spirally arranged ribs on each disk being arranged in at least two radially positioned steps, the steps being separated radially by rotating spaces, wherein a radially outer step has at least one more pumping chamber than a radially inner step; and cooling means provided in the space between an outlet of the radially outer step and an inlet of the radially inner step of at least one disk, the cooling means rotating with the space.

2. The spiral pump as claimed in claim 1, wherein the cooling means comprise cooling ribs projecting from the inner face of a first displacement disk, around which cooling ribs a fluid passes, said cooling ribs extending spirally on said first displacement disk in the space between the outlet of the radially outer step and the inlet of the radially inner step.

3. The spiral pump as claimed in claim 2, wherein ventilating blades are provided on the outer side of at least the displacement disk which bears the cooling ribs.

4. The spiral pump as claimed in claim 1, wherein each displacement disk further comprises a conduit in the space between steps through which a fluid exiting the radially outer step passes for cooling before entering the radially inner step, said conduit being formed with walls on the outer side of the displacement disk, and said cooling means comprising fins formed on the outside of the conduit walls.

* * * * *